US005173669A

United States Patent [19]

Manoly

[11] Patent Number: 5,173,669

[45] Date of Patent: Dec. 22, 1992

[54] SLOW-WAVE STRUCTURE HAVING BLOCK SUPPORTED HELIX STRUCTURE

[75] Inventor: Arthur E. Manoly, Rancho Palos Verdes, Calif.

[73] Assignee: Hughes Aircraft Company, Los Angeles, Calif.

[21] Appl. No.: 577,164

[22] Filed: Sep. 4, 1990

[51] Int. Cl.[5] ..... H01J 23/27

[52] U.S. Cl. ..... 333/162; 315/3.5

[58] Field of Search ..... 315/3.5, 3.6, 39.3, 315/39 TW; 333/156, 162

[56] References Cited

U.S. PATENT DOCUMENTS

| | | | |
|---|---|---|---|
| 2,889,487 | 6/1959 | Birdsall et al. | 315/3.6 |
| 3,519,964 | 7/1970 | Chorney et al. | 315/3.5 X |
| 3,670,196 | 6/1972 | Smith | 315/3.5 |
| 3,691,630 | 9/1972 | Burgess et al. | 315/3.5 X |
| 4,185,225 | 1/1980 | Doehler et al. | 315/3.5 |
| 4,229,676 | 10/1980 | Manoly | 315/3.5 |
| 4,278,914 | 7/1981 | Harper | 315/3.5 |
| 4,647,816 | 3/1987 | Heynisch | 315/3.5 |

FOREIGN PATENT DOCUMENTS 1941034 2/1971 Fed. Rep. of Germany ..... 315/39.3

*Primary Examiner*—Eugene R. LaRoche
*Assistant Examiner*—Benny T. Lee
*Attorney, Agent, or Firm*—Terje Gudmestad; W. K. Denson-Low

[57] ABSTRACT

The helix (10) of a slow-wave structure of a traveling wave tube is supported by a number of spaced dielectric blocks (34, 36) that are carried by a helical ribbon (26) in registry with the helix (10) itself. Registration of the ribbon (26) and its blocks (34, 36) with the helix structure (10) is facilitated by first winding a guide wire (40) in the spaces (16) between successive turns of the helix (10), to extend into and protrude radially outwardly from the spaces (16). After use of the guide wire (40) to align the ribbon-supported dielectric blocks (34, 36), the guide wire (40) is removed and the assembly of helix (10), blocks (34, 36) and supporting ribbon (26) is secured in its tubular envelope (20) by brazing, coining or heat-shrinking.

13 Claims, 3 Drawing Sheets

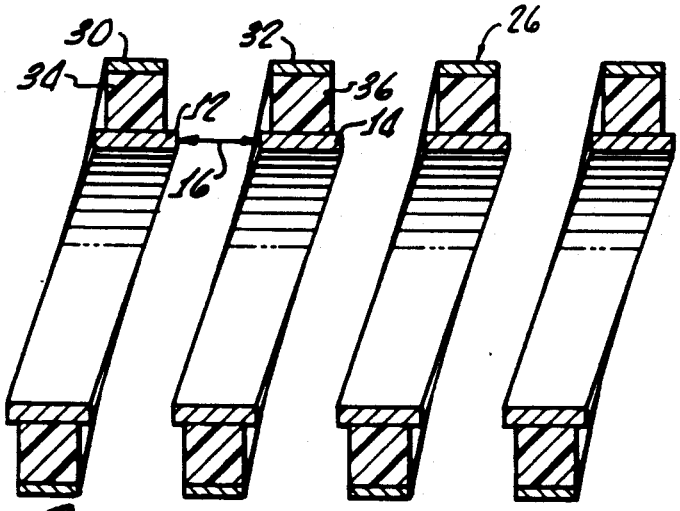
FIG. 2.
FIG. 1.
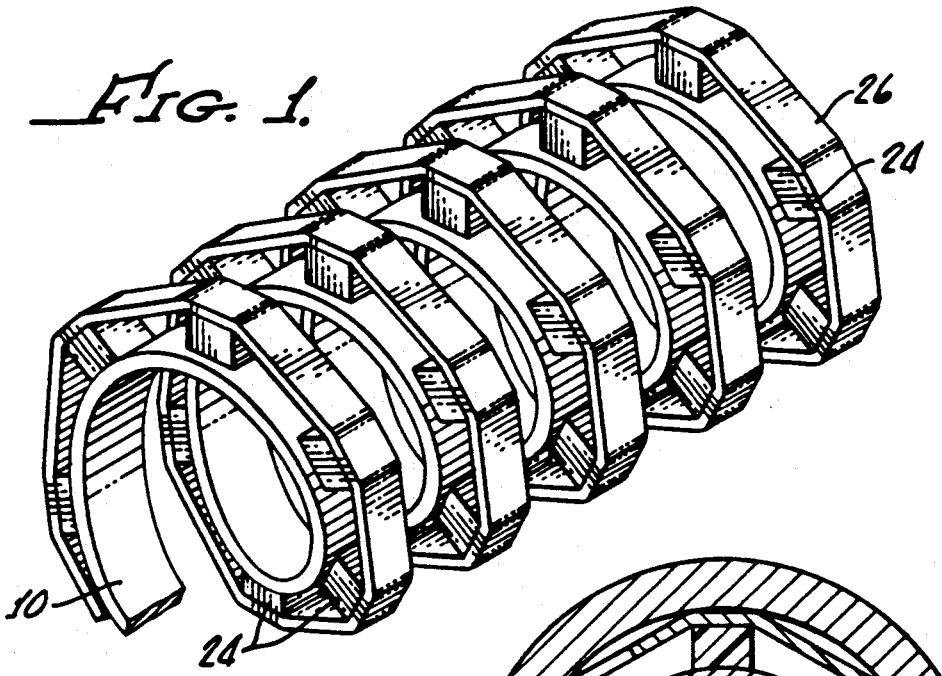
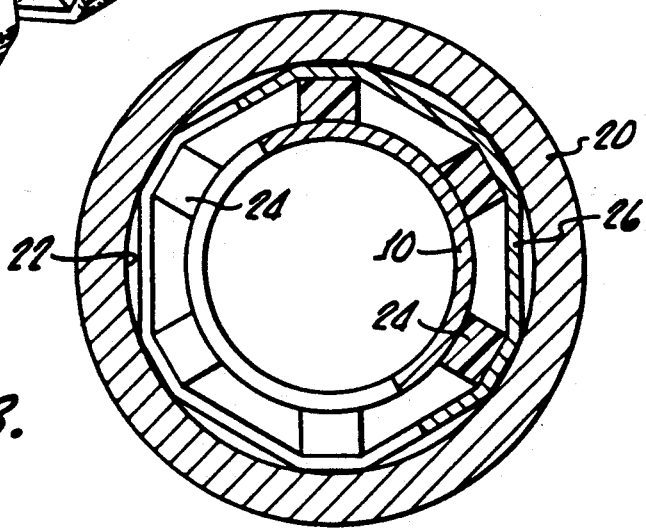
FIG. 3.

SLOW-WAVE STRUCTURE HAVING BLOCK SUPPORTED HELIX STRUCTURE

BACKGROUND OF THE INVENTION

1. Field of the Invention

The present invention relates to traveling wave tubes and, more particularly, concerns the slow-wave structure of such tubes and a method of manufacture.

2. Description of Related Art

In traveling-wave tubes, a stream of electrons is caused to interact with a propagating electromagnetic wave in a manner that amplifies energy of the electromagnetic wave. To achieve desired interaction between the electron stream and the electromagnetic wave, the latter is propagated along a slow-wave structure, such as an electrically-conductive helix that is wound about the path of the electron stream. The slow-wave structure provides a path of propagation for the electromagnetic wave that is considerably longer than the straight axial length of the structure, so that the traveling electromagnetic wave may be made to propagate axially at nearly the same velocity as the electron stream.

Slow-wave structures of the helix type have been supported within a tubular housing by means of a plurality of longitudinally disposed dielectric rods that are circumferentially spaced about the slow-wave helix structure. Some supporting assemblies have employed a coaxial helix of dielectric material wound in the same sense as and aligned with the slow-wave structure helix, positioned between the slow-wave structure helix and the housing.

A helical supporting arrangement for a slow-wave structure is disclosed in U.S. Pat. No. 3,670,196 to Burton H. Smith. The Smith patent employs a mandrel having a helical groove in which is formed both the conductive helix and the overlying dielectric helix.

U.S. Pat. No. 4,115,721 to Walter Friz shows an arrangement similar to that of the Smith patent, but instead of mechanically winding a helical dielectric member in the mandrel groove, the dielectric material is plasma-sprayed into the groove, after which the materials are precision ground to a desired radial dimension.

U.S. Pat. No. 4,005,321 to Arthur E. Manoly, assigned to the assignee of the present invention, discloses an arrangement in which a plurality of axially-extending boron nitride support rods of rectangular cross section are disposed about the surface of the slow-wave helix structure, between the envelope and the helix.

U.S. Pat. No. 4,229,676 to Arthur E. Manoly, assigned to the assignee of the present invention, describes a slow-wave structure with a helical dielectric support.

U.S. Pat. No. 2,851,630 to Charles K. Birdsall describes a traveling-wave tube with a helical slow-wave structure having a gradually decreasing pitch that causes axial velocity of the traveling wave to decrease in a manner corresponding to decrease in axial velocity of the electron stream.

U.S. Pat. No. 3,972,005 to John E. Nevins, Jr., et al describes a traveling-wave tube that is provided with a conductive loading arrangement that increases bandwidth.

The helix support structures of the prior art exhibit a number of problems. Axially-extending support rods are slender and brittle, and therefore difficult to handle. They tend to be easily broken into smaller sized pieces. Particularly because they extend across the inter-turn spacing of the conductive helix, they adversely affect dielectric loading. Moreover, structures which employ three or four axially-extending rods provide relatively low capacity thermal paths between the outer tubular envelope and the conductive helix.

Methods of forming helical dielectric supports involve a number of complex processing steps and are difficult to accomplish with precision, particularly for the higher frequency devices wherein circuit components are exceedingly small.

Where a type of comb support structure has been used, employing a plurality of circumferentially-spaced, longitudinally extending rails to which are attached dielectric blocks spaced so as to contact the successive turns of the conductive helix, difficulties are encountered with obtaining proper registration of the blocks with the turns of the conductive helix. These difficulties are increased where velocity taper is employed so that helix pitch changes near the output end of the structure. Moreover, thermal capacity, namely the ability of the support structure to conduct heat from the electrically-conductive helix to the tubular support envelope, is limited.

Accordingly, it is an object of the present invention to provide a slow-wave structure and dielectric support therefor which avoids or minimizes above-mentioned problems.

SUMMARY OF THE INVENTION

In carrying out principles of the present invention in accordance with a preferred embodiment thereof, an electrically-conductive helix is mounted in a tubular envelope by means of a helical support strip that is mounted adjacent the envelope between the helix and the envelope. A plurality of dielectric blocks mounted between the helix and the support strip directly contact the conductive helix to provide support and thermal transfer paths. A structure involving concepts of the present invention may be fabricated by winding a guide wire around the helix to extend partly into and out of the spaces between successive turns of the conductive helix, mounting a plurality of mutually-spaced dielectric support blocks on a flexible ribbon, and winding the ribbon with its support blocks around the turns of the helix while using the guide wire to ensure registration of the ribbon and dielectric blocks with the helix. Thereafter, the guide wire is removed and the subassembly of conductive helix, dielectric blocks and ribbon are inserted into and secured to the tubular envelope.

BRIEF DESCRIPTION OF THE DRAWINGS

In the accompanying drawings:

FIG. 1 is a pictorial illustration of a subassembly of conductive helix, support blocks and supporting ribbon embodying principles of the present invention;

FIG. 2 is a longitudinal section through the subassembly of conductive helix, support blocks and support ribbon of FIG. 1;

FIG. 3 is a transverse cross section of the assembled helix, support structure and tubular envelope;

DESCRIPTION OF THE PREFERRED EMBODIMENT

Figure 7:
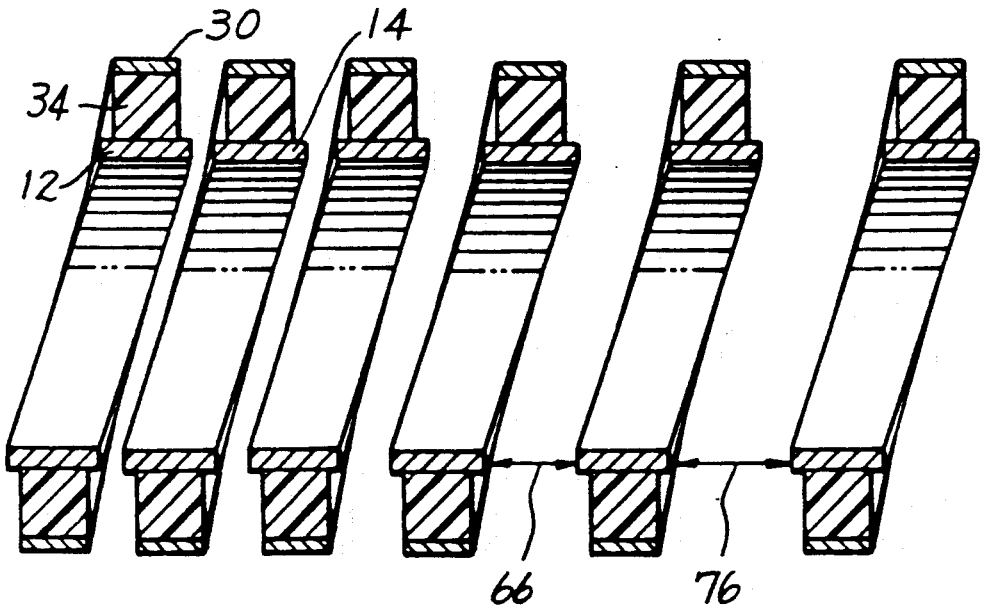
FIG. 7 is a longitudinal section through the subassembly of a conductive helix having a variable pitch, with like numbers referring to like elements of the conductive helix of FIG. 2.

Referring now to FIGS. 1, 2 and 3, which show the slow-wave structure of a traveling wave tube, an electrically-conductive helix 10, formed of a suitable material such as tungsten, molybdenum or copper, is formed with a plurality of turns, two of which are indicated at 12 and 14 in FIG. 2, having a pitch which forms an inter-turn space 16. The helix in FIG. 7 is a variable pitch helix in which the inter-turn space 66, 76 varies. The slow-wave structure, as is well known, may have portions of its longitudinal extent formed with the same pitch and may have other portions formed with a somewhat decreasing pitch for velocity taper of the electromagnetic traveling wave at its outer end. This decreased pitch decreases axial velocity of the traveling electromagnetic wave, so as to more closely match the velocity of the stream of electrons, which has been slowed to some extent because of its interaction with the electromagnetic wave.

The helix 10 is supported in an outer tubular envelope 20 (FIG. 3), having a right circular cylindrical internal surface 22, by means of a plurality of individual dielectric blocks 24 which may be formed of a suitable dielectric material, such as boron, nitride, beryllium oxide or diamond. Interposed between the dielectric blocks 24 and envelope 20 is a continuous flexible ribbon or support strip 26 that has a generally helical configuration. The support strip or ribbon 26 has the turns of its helix in radial alignment with or in registration with the respective associated turns of the helix 10. Thus, as can be seen in FIG. 2, for example, support strip 26 may have turns such as those indicated at 30 and 32 which are respectively in radial registration with associated turns 12, 14 of the helix structure.

Dielectric blocks, such as blocks 34, 36, are interposed between the flexible support strip 30, 32 and the helix turns 12, 14, respectively, and are radially aligned or in registration with both the support strip and the helix.

Figure 4:
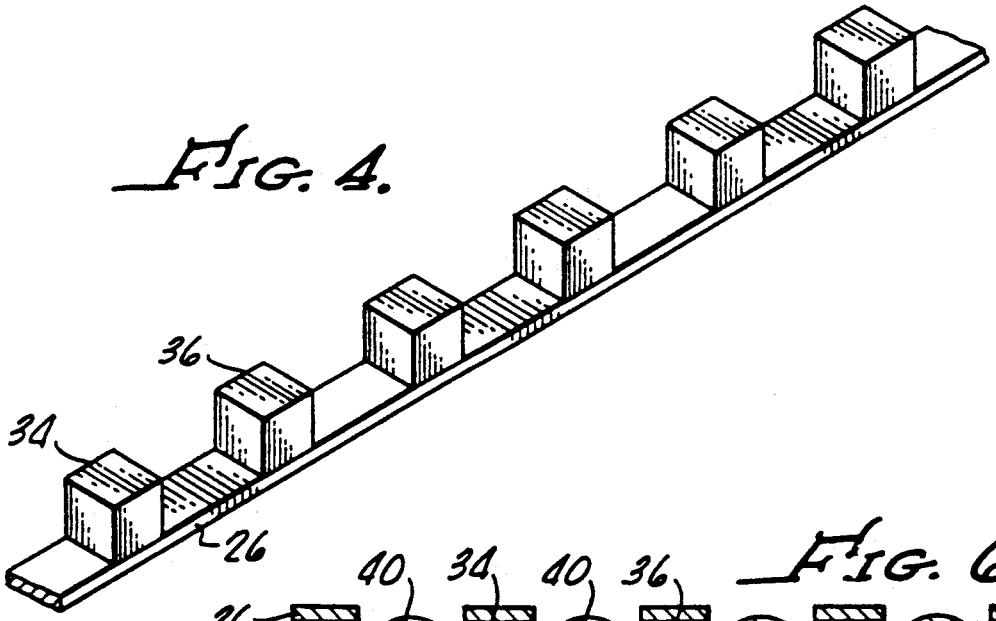
FIG. 4 shows a ribbon having support blocks.

For manufacture and assembly of the slow-wave structure shown in FIG. 3, the conductive helix 10 is initially formed. Then a subassembly of dielectric blocks 34, 36, and the like (as shown in FIG. 4), is mounted on a flexible ribbon or support strip 26, with the blocks 34, 36, etc., being mutually spaced along the length of the strip. Preferably, the support strip 26 is made of a metal, such as molybdenum, copper or tungsten, which is flexible, strong and of good thermal conductivity. Typically, the dielectric blocks 34, 36 may be formed of cubes approximately 0.020 inch per side, and the support strip 26 will have a width equal to the width of the blocks and a thickness of about 0.003 to 0.005 inch.

Figure 5:
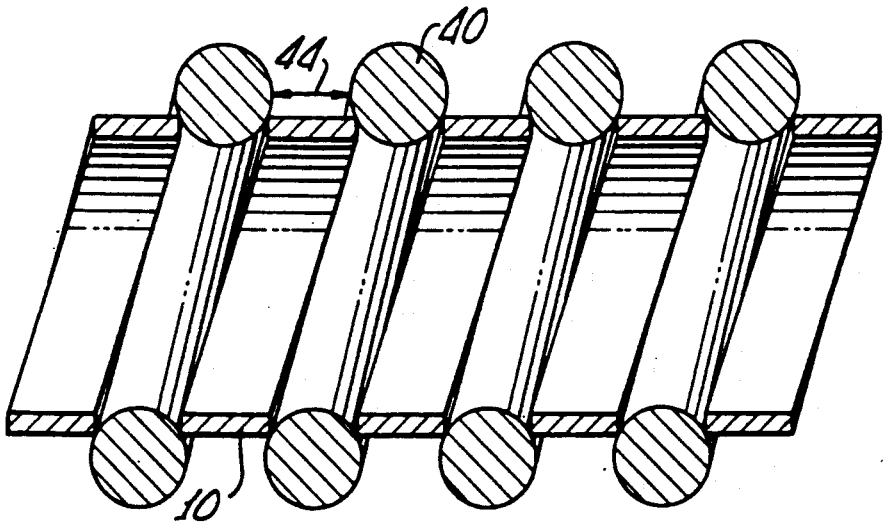
FIG. 5 illustrates application of the guide wire to the helix.
Figure 6:
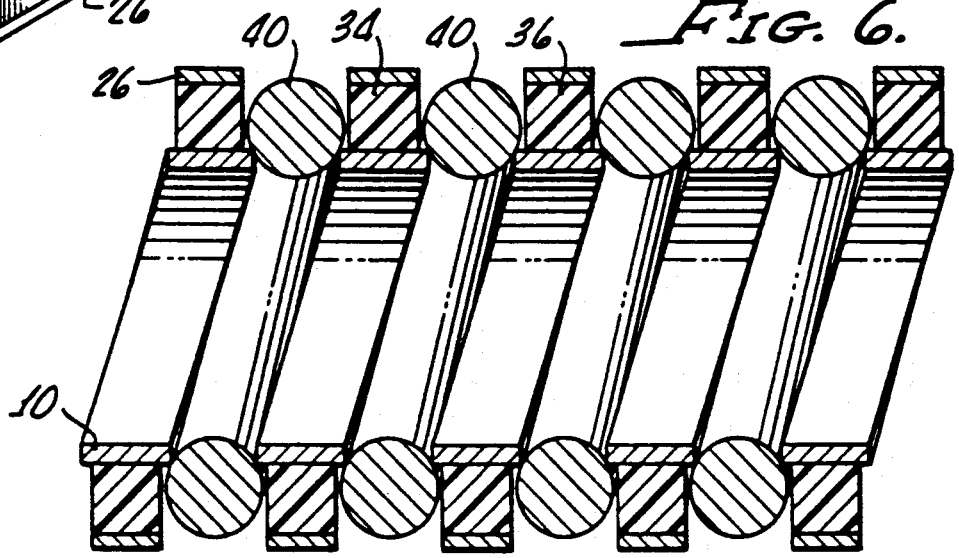
FIG. 6 shows the guided positioning of the helical support ribbon and its dielectric blocks on the helix between the helical turns of the guide wire.

The dielectric blocks are bonded to the strip and then the subassembly of strip and dielectric blocks is wound around the turns of the conductive helix 10. However, in order to ensure registration of the subassembly of dielectric blocks and support ribbon, there is employed a continuous guide wire 40, as is illustrated in FIG. 5, formed of a flexible and bendable material that tends to remain in a configuration into which it may be bent. Guide wire 40 is a continuous wire, preferably of circular cross section, having a diameter slightly greater than the space 16 between the successive turns of the conductive helix, so that when the wire is wound around the helix 10 it will slightly protrude into the space between the successive turns of the helix, thereby precisely positioning the guide wire in a helical configuration that exactly matches the configuration of helix 10. The guide wire will also project radially outwardly from the inter-turn spaces of helix 10, as can be seen in FIG. 5. The diameter of the wire 40 is sufficiently greater than the space between successive turns of the helix, so that it will have a substantially similar projecting relation to the helix even where the pitch of the helix varies at the output section as it may for velocity taper.

Where the helix pitch varies as shown in FIG. 7, the pitch of the guide wire varies in like manner. Thus, the flexible wire, when wound around and partly into the inter-turn spaces of the helix, provides a helical guide channel, such as the channel indicated at 44 in FIG. 5, formed by the space between successive turns of the now helically-configured guide wire. This helical guide channel is employed to guide the positioning of the subassembly of dielectric blocks and support ribbon into precise registration with the turns of the conductive helix 10. It will be understood that both the guide wire and the support strip 26 are flexible but have a relatively low modulus of elasticity, so that, when bent into the desired helical configuration, they will retain such configuration and not tend to return to the straight condition (FIG. 4) in which they are initially formed. Thus, after the guide wire has been positioned as shown in FIG. 5, the subassembly of support strip and dielectric blocks is wound in the helical guide channel formed by the wire, and thus positioned directly upon and in precision radial registration with the turns of the conductive helix as shown in FIG. 6. If deemed necessary or desirable, the dielectric blocks may be bonded to the helix surfaces. Next the guide wire 40 is removed and there results a subassembly of the configuration shown in FIG. 1, which includes the helix 10 about which is helically wound the support strip 26 with dielectric blocks 24, etc., interposed between and in registry with both the support strip and the helix. The subassembly of FIG. 1 is then inserted into the tubular envelope 20, and the entire assembly has its parts secured to one another as by brazing, coining or heat-shrinking.

In initially securing the dielectric blocks to the support strip 26 (as shown in FIG. 4), the blocks may be bonded to the support strip by any suitable means. Permanent bonding is not necessary, since the mechanical interconnection of the parts during final assembly will hold all of the elements in place. Thus, the blocks may be either brazed or adhesively secured to the strip 26, as by a Lucite adhesive. The latter may be vaporized after assembly in the envelope. Similarly, if deemed necessary or desirable, the dielectric blocks, when assembled upon the outer surfaces of the electrically-conductive helix, may be suitably bonded thereto. For final assembly of the subassembly of helix, dielectric blocks and support strip 26 with the tubular envelope, heat-shrinking may be accomplished by inserting the subassembly into a preheated envelope and allowing the envelope to cool and to thermally contract, to thereby tightly clamp all the parts together. Assembly of the parts by coining is analogous to heat-shrinking in that high pressures are employed to radially compress the envelope by mechanical means.

The structure and assembly techniques described above exhibit significant advantages for smaller-sized devices. Such advantages are available when the described slow-wave structure is used as part of an otherwise conventional traveling-wave tube that is made for operation at frequencies above about 12 gigahertz. These advantages increase as frequency increases, because as frequency increases the size of the circuit components decrease. The described structure and method exhibit maximum advantage and benefits at frequencies above 20 gigahertz, where the circuit components are smallest. For such small-sized components, the structural arrangements and assembly methods of the prior art have many disadvantages. Such disadvantages of small size, high frequency traveling wave tubes are overcome by the structure and method of the present invention which provides a number of significant advantages.

These advantages include the fact that no registration of support blocks with the successive turns of the conductive helix is required, as it is in an arrangement using axially-extending support strips. In the invention described herein, spacing of the blocks and the helix pitch are completely independent of one another. Thus, the present invention can be used with any velocity taper (a decrease in pitch at the output section), because the blocks automatically follow around the helical path of the helix.

The system provides low dielectric loading, because there is no structure that bridges the inter-turn space as in those of prior art arrangements utilizing a continuous, axially-extending dielectric support block. Accordingly, higher impedance and higher efficiency are obtained.

Thermal capacity of the present system can be controlled by the spacing of the blocks, and increased thermal capacity is readily available by decreasing the inter-block spacing. Spacing of the dielectric blocks can be controlled not only for increased thermal capacity but also for the matching of velocity taper effects at the output.

The described system has a lower dielectric loading than a three or four rod structure wherein several longitudinally-extending, continuous dielectric support rods are employed. The present system also has a higher thermal capacity than the type of structure employing a continuous, longitudinally-extending support that carries dielectric blocks for each turn of the conductive helix. In the latter arrangement, decreased spaces between dielectric blocks along the helical path of the helix cannot be provided without greatly increasing the total number of longitudinally-extending support strips; whereas in the present arrangement the helical spacing of the blocks is very simply decreased by appropriate positioning of the blocks upon the support strip.

What is claimed is:

1. A slow-wave structure comprising:

a tubular envelope, an electrically-conductive helix in the envelope having a plurality of helical turns, flexible and continuous helical support strip mounted adjacent said envelope between said helix and said envelope, and a plurality of dielectric blocks mounted between said helix and said helical support strip, said helical support strip and blocks comprising a separate subassembly wound around the turns of said helix.

2. The structure of claim 1 wherein said helical support strip is in radial alignment with said helix.

3. The structure of claim 1 wherein said helix has a predetermined spacing between turns, and wherein said helical support strip has a plurality of turns with said predetermined spacing between the turns of the helical support strip.

4. The structure of claim 1 wherein said blocks are mutually spaced along said support strip.

5. The structure of claim 1 wherein said blocks are spaced along said helical support strip, and wherein turns of said helix have a width, said helical support strip and said blocks each having a width that is the same as the width of said helix turns, and all of said turns of said helix, said helical support strip and said blocks being aligned with each other.

6. The structure of claim 5 wherein 5 wherein said support strip comprises a metal.

7. A slow wave structure comprising:

a tubular envelope, an electrically conductive helix in said envelope, said helix having a plurality of helical turns spaced from said envelope, a length of continuous flexible ribbon forming a support strip for said helix, said support strip having a plurality of dielectric blocks bonded to said ribbon in spaced relation to one another, said support strip and blocks being a helical configuration wound around the turns of said helix and interposed between said helix and said envelope with the dielectric blocks in contact with said helical turns and the support strip in contact with said envelope.

8. The structure of claim 7 wherein said support strip is formed of a material having low modulus of elasticity so that the support strip and blocks is in a bent configuration which remains in the shape of the helical configuration.

9. The structure of claim 7 wherein said support strip comprises a material having low modulus of elasticity and the support strip with the dielectric blocks bonded thereto is in a bent configuration which remains in the shape of the helical configuration.

10. The structure of claim 9 wherein said helical support strip has a width and wherein said blocks are cubes having a width equal to the width of said helical support strip.

11. The structure of claim 10 wherein said envelope comprises a heat shrunk envelope around said support strip and helix.

12. The structure of claim 11 wherein the helix has a variable pitch.

13. The structure of claim 7 wherein said helical support strip has a width and wherein each of said blocks has a width equal to the width of the helical support strip.

* * * * *